US010835058B2

(12) United States Patent
Sale

(10) Patent No.: US 10,835,058 B2
(45) Date of Patent: Nov. 17, 2020

(54) PAPER COMPOSITE NURSERY SHIPPING RACK

(71) Applicant: Josh Sale, Jacksonville, FL (US)

(72) Inventor: Josh Sale, Jacksonville, FL (US)

( * ) Notice: Subject to any disclaimer, the term of this patent is extended or adjusted under 35 U.S.C. 154(b) by 200 days.

(21) Appl. No.: 16/247,818

(22) Filed: Jan. 15, 2019

(65) Prior Publication Data

US 2020/0223620 A1 Jul. 16, 2020

(51) Int. Cl.
*A47F 5/11* (2006.01)
*A47B 55/06* (2006.01)

(52) U.S. Cl.
CPC ..... *A47F 5/11* (2013.01); *A47B 55/06* (2013.01)

(58) Field of Classification Search
CPC .. A47F 5/11; A47F 5/112; A47F 5/114; A47F 5/116; A47F 5/118; A47B 55/06; A47B 43/02; A47B 47/06
USPC ..... 211/72, 135, 153, 188; 206/503, 504, 206/511, 194, 736, 600
See application file for complete search history.

(56) References Cited

U.S. PATENT DOCUMENTS 11,449 A * 8/1854 Willard ..... A47C 19/20 5/9.1
2,888,147 A * 5/1959 Goldberg ..... A47F 5/116 108/25
2,941,710 A * 6/1960 Smith ..... B65D 7/28 229/199
3,834,324 A * 9/1974 Lang ..... A47B 87/0246 108/91
4,819,816 A 4/1989 Noble, Sr.
5,037,027 A * 8/1991 Nichols ..... B65D 5/0055 229/198.1
5,181,611 A * 1/1993 Liebel ..... B65D 71/04 206/453
5,251,753 A * 10/1993 Pigott ..... B65D 71/0096 206/586
5,979,338 A * 11/1999 Salmanson ..... A47B 57/22 108/107
6,123,207 A 7/2000 Mast
6,135,299 A * 10/2000 Burgess ..... A47B 46/00 211/150
6,164,537 A 12/2000 Mariani
6,305,601 B1 * 10/2001 Bazany ..... B65D 5/0055 229/198.1
6,349,877 B1 * 2/2002 Bradford ..... B65D 5/0055 206/509
6,564,993 B1 * 5/2003 Wassink ..... B65D 5/0055 220/642
7,066,342 B2 * 6/2006 Baechle ..... B65D 5/006 206/600
7,111,735 B2 * 9/2006 Lowry ..... B65D 5/52 206/586
7,137,517 B2 * 11/2006 Lowry ..... B65D 5/5033 211/188

(Continued)

*Primary Examiner* — Jonathan Liu
*Assistant Examiner* — Devin K Barnett
(74) *Attorney, Agent, or Firm* — Lawrence J. Gibney, Jr.

(57) ABSTRACT

This invention is a unique and novel shipping frame for nursery plants, that is made from a water-resistant recycled paper composite material. The frame allows for supporting one or more shelves and is attached to a base. The one or more shelves and base are capable of holding the plants during shipment to insure the plants are not damaged. After shipment is completed, the frame may be reused or disposed of accordingly.

9 Claims, 9 Drawing Sheets

(56) References Cited

U.S. PATENT DOCUMENTS 7,546,927 B2 * 6/2009 Lowry ..... A47F 3/142 206/557
8,833,573 B2 * 9/2014 Tomaszewski ..... B65D 19/385 211/126.12
9,428,298 B2 * 8/2016 Bersamin ..... B65D 5/445
9,783,333 B1 * 10/2017 De Los Santos ..... B65D 5/006
9,826,843 B1 * 11/2017 Tomaszewski ..... B65D 5/002
10,315,798 B2 * 6/2019 Pfeifer ..... B65D 19/0012
10,750,866 B2 * 8/2020 Grupenhof ..... A47B 57/54
2002/0195410 A1 * 12/2002 Lin ..... A47B 57/16 211/190
2005/0092633 A1 * 5/2005 Baechle ..... B65D 61/00 206/320
2005/0121357 A1 * 6/2005 Robinson, Jr. ..... B65D 81/054 206/586
2006/0108408 A1 * 5/2006 Lowry ..... B65D 5/321 229/199
2006/0175227 A1 * 8/2006 Lau ..... B65D 15/22 206/600
2006/0249565 A1 * 11/2006 Wood ..... B65D 5/002 229/164
2007/0017843 A1 * 1/2007 Keel ..... B65D 71/0096 206/509
2009/0032432 A1 * 2/2009 Kostos ..... B65D 71/0096 206/600
2010/0133215 A1 * 6/2010 Norman ..... A47B 87/0261 211/85.8
2011/0220544 A1 * 9/2011 De Alba ..... B65D 19/385 206/600
2013/0008865 A1 * 1/2013 Su ..... A47F 5/11 211/153
2013/0026060 A1 * 1/2013 Moss ..... B65D 5/0035 206/512
2014/0110366 A1 * 4/2014 Wu ..... A47B 47/024 211/135
2015/0157144 A1 * 6/2015 Lamarre ..... A47F 5/11 211/135
2019/0116994 A1 * 4/2019 Mertz, II ..... B65D 71/0096

* cited by examiner

PAPER COMPOSITE NURSERY SHIPPING RACK

BACKGROUND OF THE INVENTION

A. Field of the Invention

This invention relates to a nursery rack that is framed with a lightweight water resistant paper composite material that is easy to assemble and disassemble for disposal or re-use.

B. Prior Art

Nursery shipping racks have been used for a long period of time to secure plants during shipment from the nursery to the designated delivery location. The nursery racks have been traditionally made of wood, which is nailed or screwed together and are still used today. The issue with using wood racks is that they are heavy and usually not re-usable because they are very difficult to disassemble and can rot if left outside unprotected. It is very common for nursery racks made of wood to be destroyed and burned or thrown away after one use because it would cost more to ship the rack back to the nursery than the wooden rack is worth. Consequently, the nursery industry moving away from wooden nursery racks because the use of wooden racks is quite wasteful.

As an alternative, the industry has been gradually moving towards metal racks because they are lighter and more durable for re-use than the traditional wood racks. However, use of industry. For instance, metal racks generally cost significantly more than a traditional wood rack. Accordingly, the metal racks are not destroyed after a shipment. Instead empty metal nursery racks are shipped back to the nursery for future deliveries. Consequently, the costs of delivering plants with metal nursery racks are dramatically increased due to the extra shipment of empty nursery racks. Moreover, the urgency of shipping the metal racks is critical for timely deliveries during peak seasons.

The present invention provides a stable nursery rack that uses a recycled paper based composite material that is lightweight, weather resistant, and disposable. Due to the lightweight composite material, the frame of the rack requires a unique and novel frame structure.

BRIEF SUMMARY OF THE INVENTION

This present device is a nursery shipping rack that is described in three embodiments. The first embodiment is comprised of a frame made from a paper and plastic composite material, a base and one or more shelf panels. The paper composite material used to make angle boards, which are also often referred to as "v-board". The frame is further comprised of a plurality of outer vertical supports, a plurality of inner vertical supports, a plurality of support spacers, a plurality of upper horizontal supports, and a plurality of lower horizontal supports. The vertical supports, horizontal supports, and support spacers are each angle boards and may be connected together with staples.

The plurality of outer vertical supports are attached to the sides of the base and extend upward. The plurality of vertical inner supports and the plurality of vertical support spacers assist with providing rigidity to the outer vertical supports as well as upholding the plurality of upper horizontal supports and the plurality of lower horizontal supports. In turn, the plurality of horizontal supports are attached to the plurality of outer vertical supports and the plurality of inner vertical supports while also resting on the vertical spacer and inner vertical support.

Each shelf panel is then attached to each plurality of upper horizontal supports, which the nursery plants will be placed on. Nursery plants may additionally be placed on the base of the shipping rack. It is anticipated that each shelf panel and the base could be made from wood or from the same recycled paper based composite material that the frame is made from.

The second embodiment removes the upper horizontal support and allows for each shelf panel to be attached to each plurality of lower horizontal supports. This consequently allows for easy loading and removal of nursery plants for the shipping rack. The second embodiment additionally provides a plurality of diagonal supports which is attached to at least two of the plurality of outer vertical supports and a plurality of rack straps which are wrapped around the plurality of outer vertical supports and plurality of diagonal supports.

The third embodiment provides a plurality of angle shelf boards as an alternative to the shelf panels used in the first and second embodiment. This use of the plurality of angle shelf boards allows for greater customization of the shipping rack shelf to accommodate tall plants as well as short plants. The use of the plurality of angle shelf boards also assists with reducing the overall weight of the nursery shipping rack.

With the use of the angle board supports, this invention provides a new and innovative disposable nursery rack that minimizes the use of wood or may remove the use of wood entirely. This rack also provides an environmentally friendly option to significantly reduce shipping costs by utilizing the lightweight paper composite material.

NUMBERING REFERENCE

Figure 1:
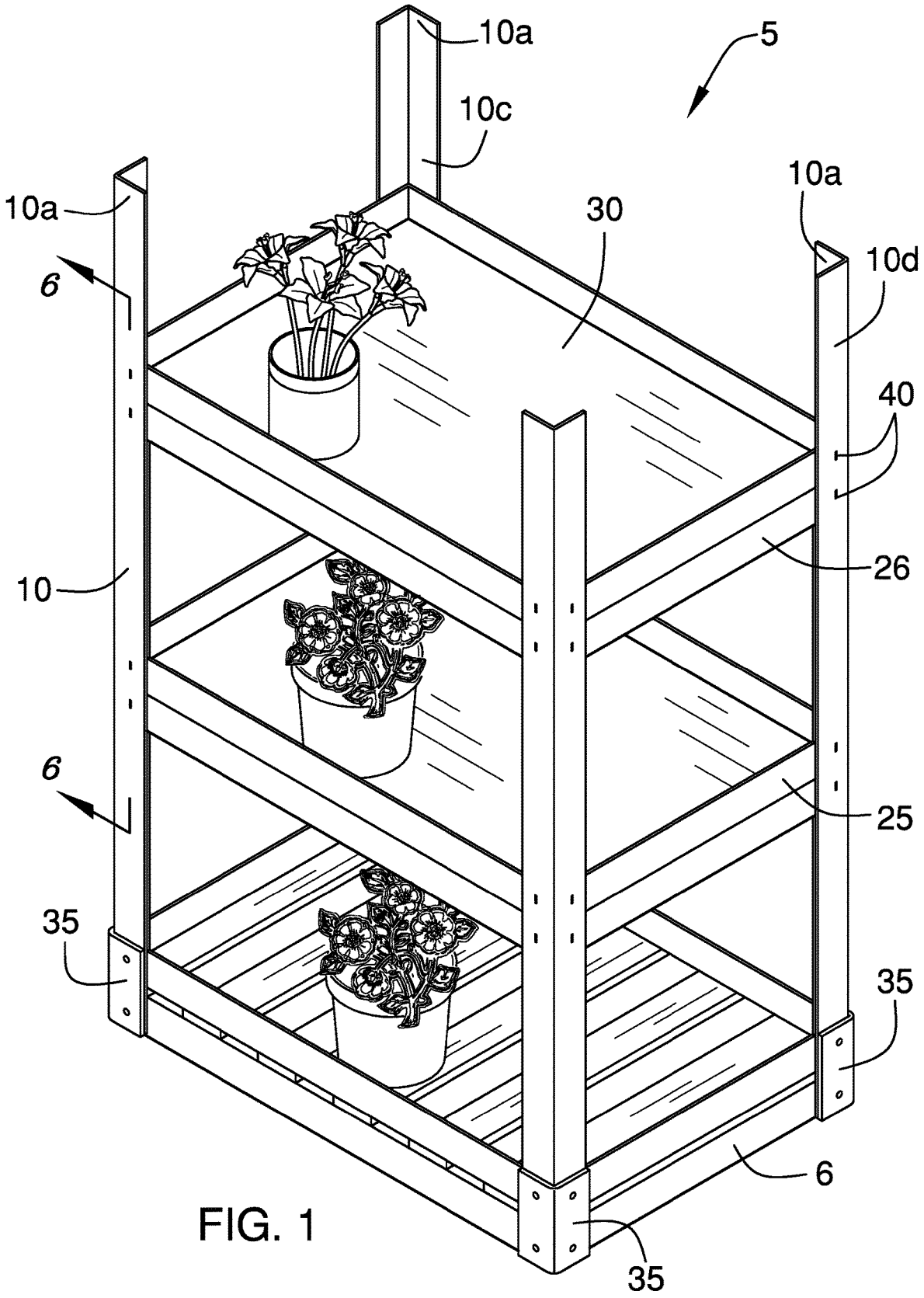
FIG. 1 is a front isometric view of the first embodiment.
Figure 2:
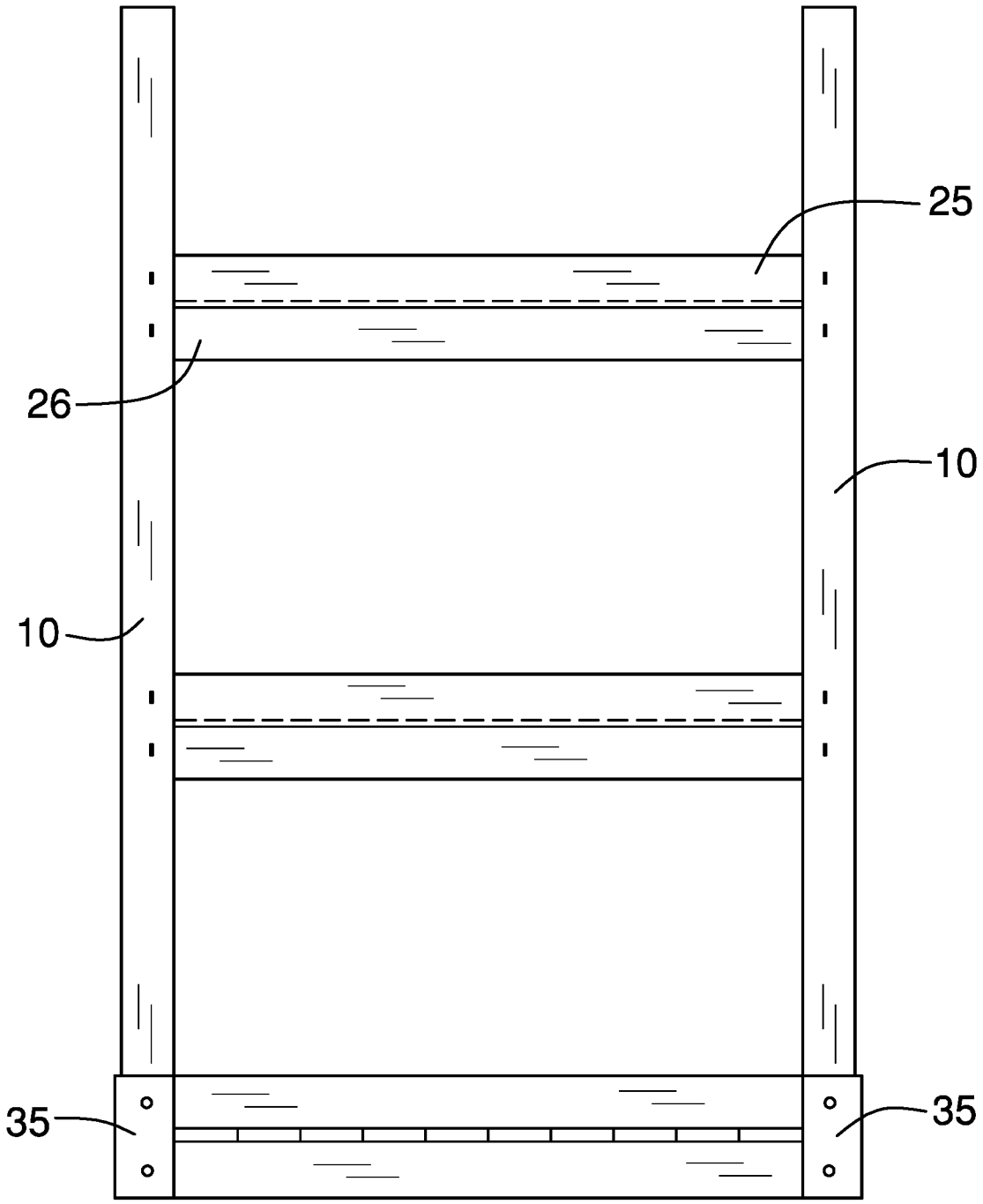
FIG. 2 is a rear view of the first embodiment.
Figure 3:
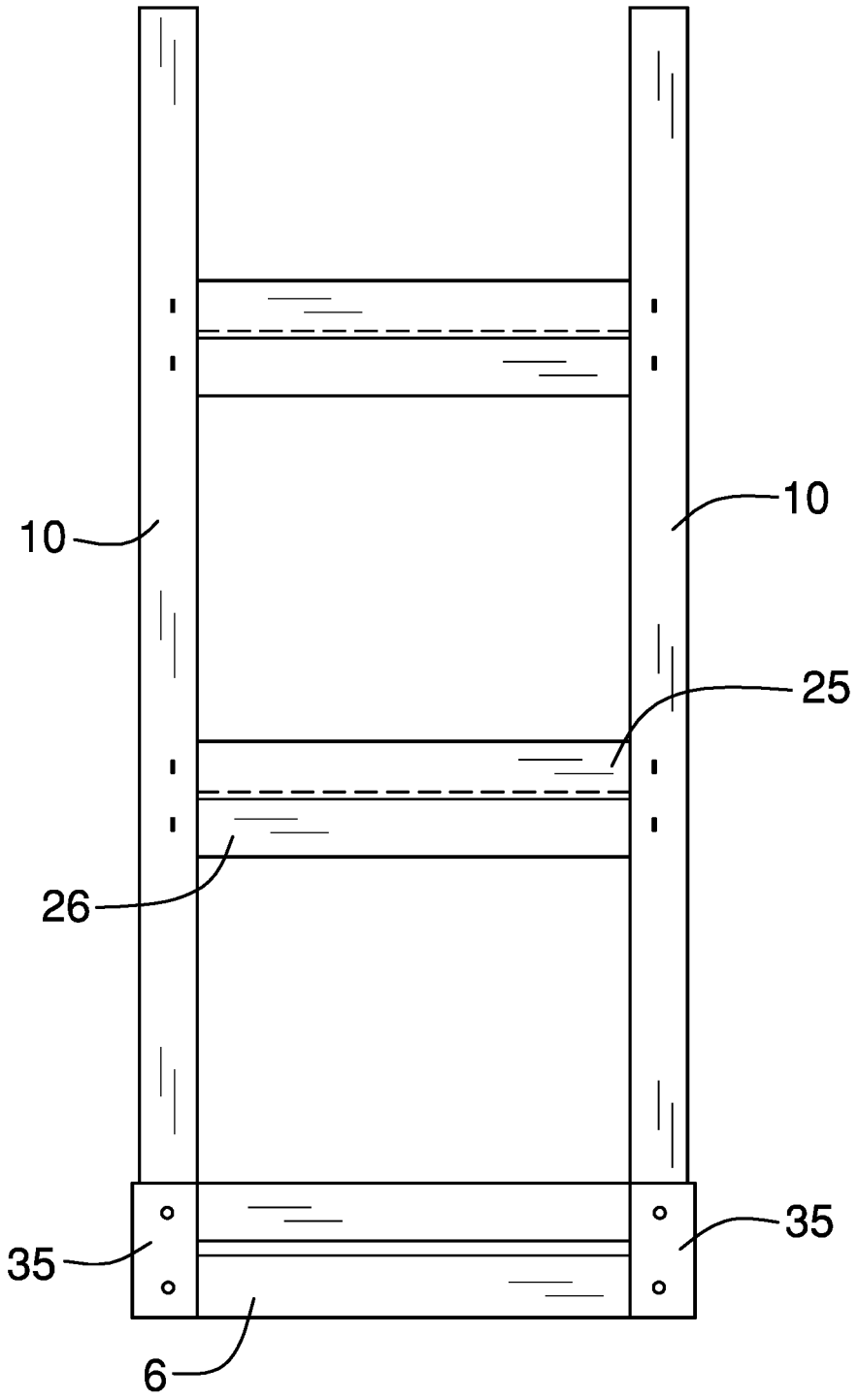
FIG. 3 is a side view of the first embodiment.
Figure 4:
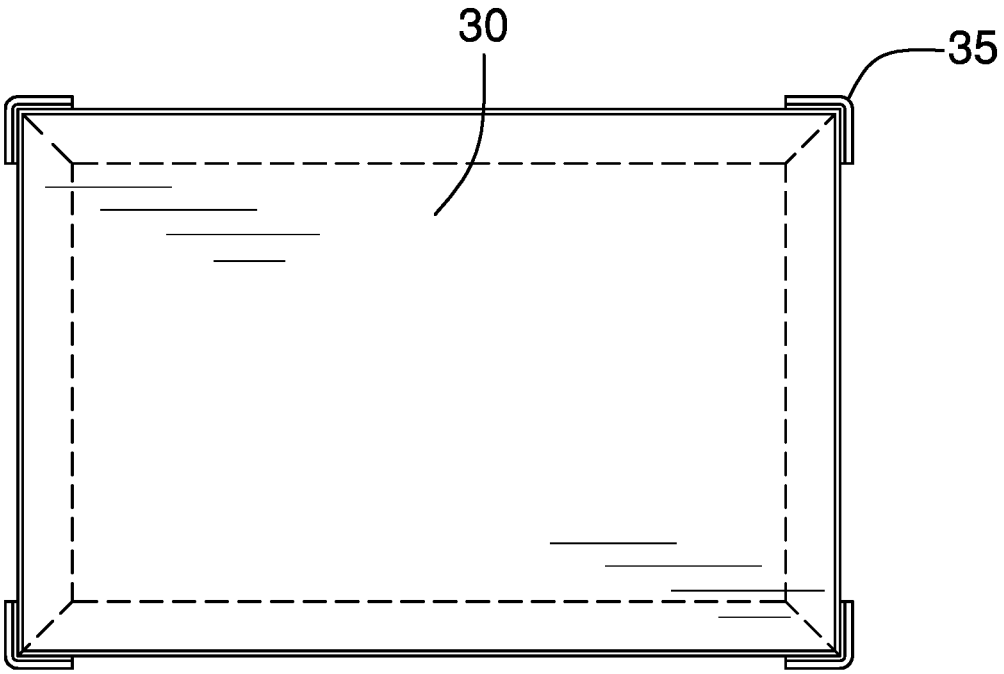
FIG. 4 is a top view of the first embodiment.
Figure 5:
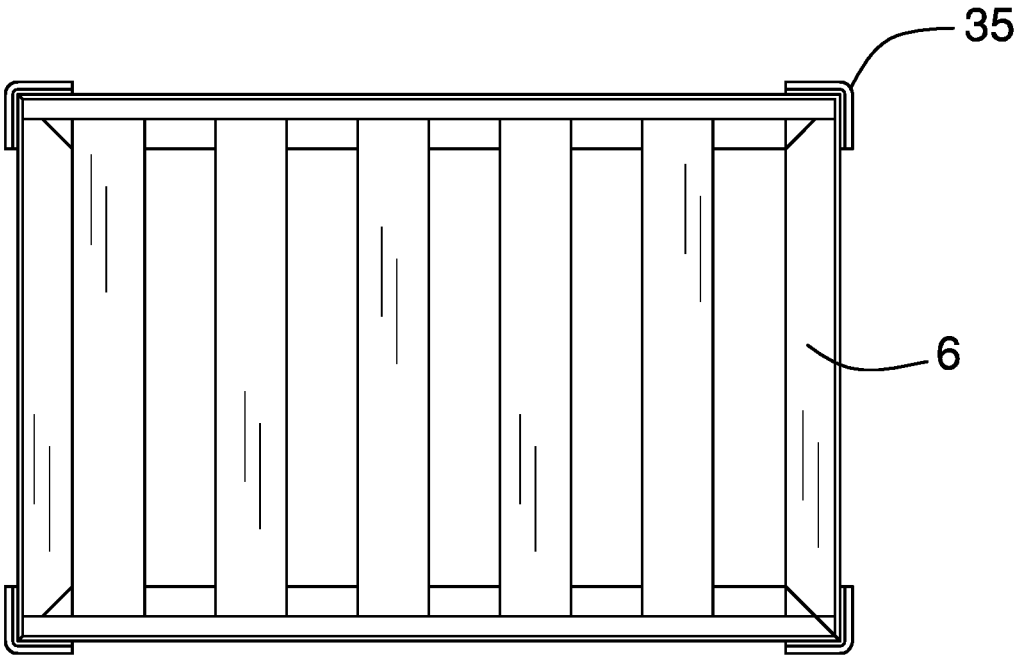
FIG. 5 is a bottom view of the first embodiment.

5—First embodiment
6—Base
10—Plurality of outer vertical supports
10*a*—Plurality of top ends of outer vertical supports
10*b*—Plurality of bottom ends of outer vertical supports
10*c*—Plurality of interior surfaces of outer vertical supports
10*d*—Plurality of exterior surfaces of outer vertical supports
15—Plurality of inner vertical supports
15*a*—Plurality of top ends of inner vertical supports
15*b*—Plurality of bottom ends of inner vertical supports
15*c*—Plurality of interior surfaces of inner vertical supports
15*d*—Plurality of exterior surfaces of inner vertical supports
20—Plurality of support spacers
20*a*—Plurality of top ends of support spacers
20*b*—Plurality of bottom ends of support spacers
20*c*—Plurality of interior surfaces of support spacers

20*d*—Plurality of exterior surface of support spacers
25—Plurality of upper horizontal supports
25*a*—Top lip
25*c*—Bottom surface
26—Plurality of lower horizontal supports
26*a*—Bottom lip
26*b*—Bottom surface
26*c*—Top surface
30—Shelf panel
35—Plurality of guards
40—Plurality of staples
50—Second embodiment
55—Plurality of diagonal supports
60—Plurality of rack straps
100—Third embodiment
110—Plurality of angle shelf boards

DETAILED DESCRIPTION OF THE EMBODIMENTS

This device is a nursery shipping rack which is relatively light in weight, water resistant, disposable, and environmentally friendly. This nursery shipping rack is described in a first embodiment 5, a second embodiment 50, and a third embodiment 100. Although each of the three embodiments is described separately, it is anticipated that one embodiment may incorporate elements of one or more of the other embodiments. It is also anticipated that the base 6 may be a variety of different shapes, but is described and shown as being a rectangle. Additionally, while the three embodiments show two shelves, it is anticipated that more than two shelves or one shelf can also be provided.

First Embodiment

This first embodiment is comprised of a base 6, a plurality of supports made from a rigid paper based composite angle board, also known as a v-board, and at least one shelf panel 30. The plurality of paper composite material v-boards are water-resistant, thereby allowing water to shed prior to being absorbed. The plurality of supports are comprised of a plurality of outer vertical supports 10, a plurality of inner vertical supports 15, a plurality of support spacers 20, a plurality of upper horizontal supports 25, and a plurality of lower horizontal supports 26.

Each of the plurality of outer vertical supports 10 provide a top end 10*a*, a bottom end 10*b*, an interior surface 10*c*, and an exterior surface 10*d*. The bottom end 10*b* of each of the plurality of outer vertical supports 10 are attached to the corners of the base 6 as shown in FIG. 1. As FIG. 1 also shows, a plurality of guards 35 may be secured to the plurality of outer vertical supports 10 at the bottom end 10*b*. The plurality of guards 35 assist in protecting the outer vertical assists from being damaged or crippled during shipment.

Figure 6:
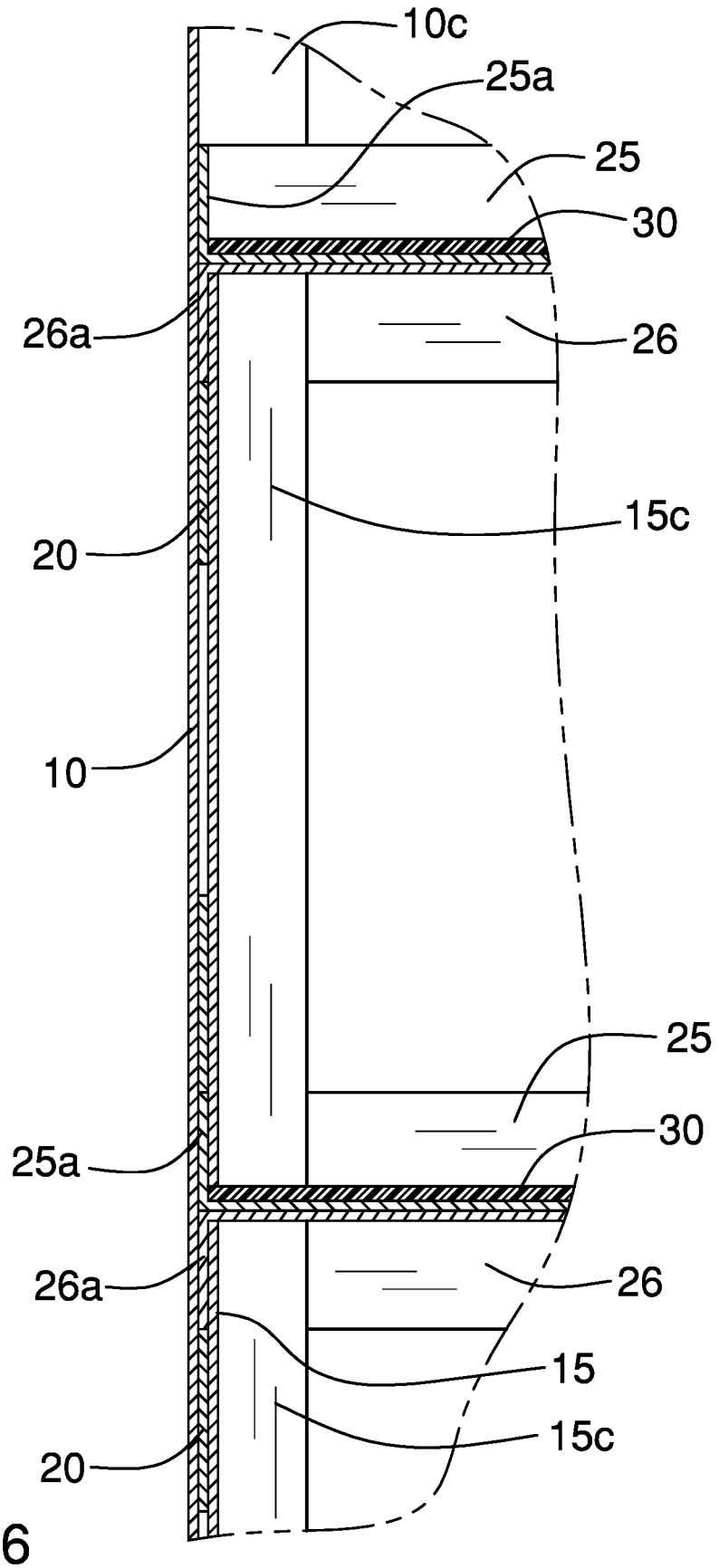
FIG. 6 is a cross-sectional view of the first embodiment.
Figure 7:
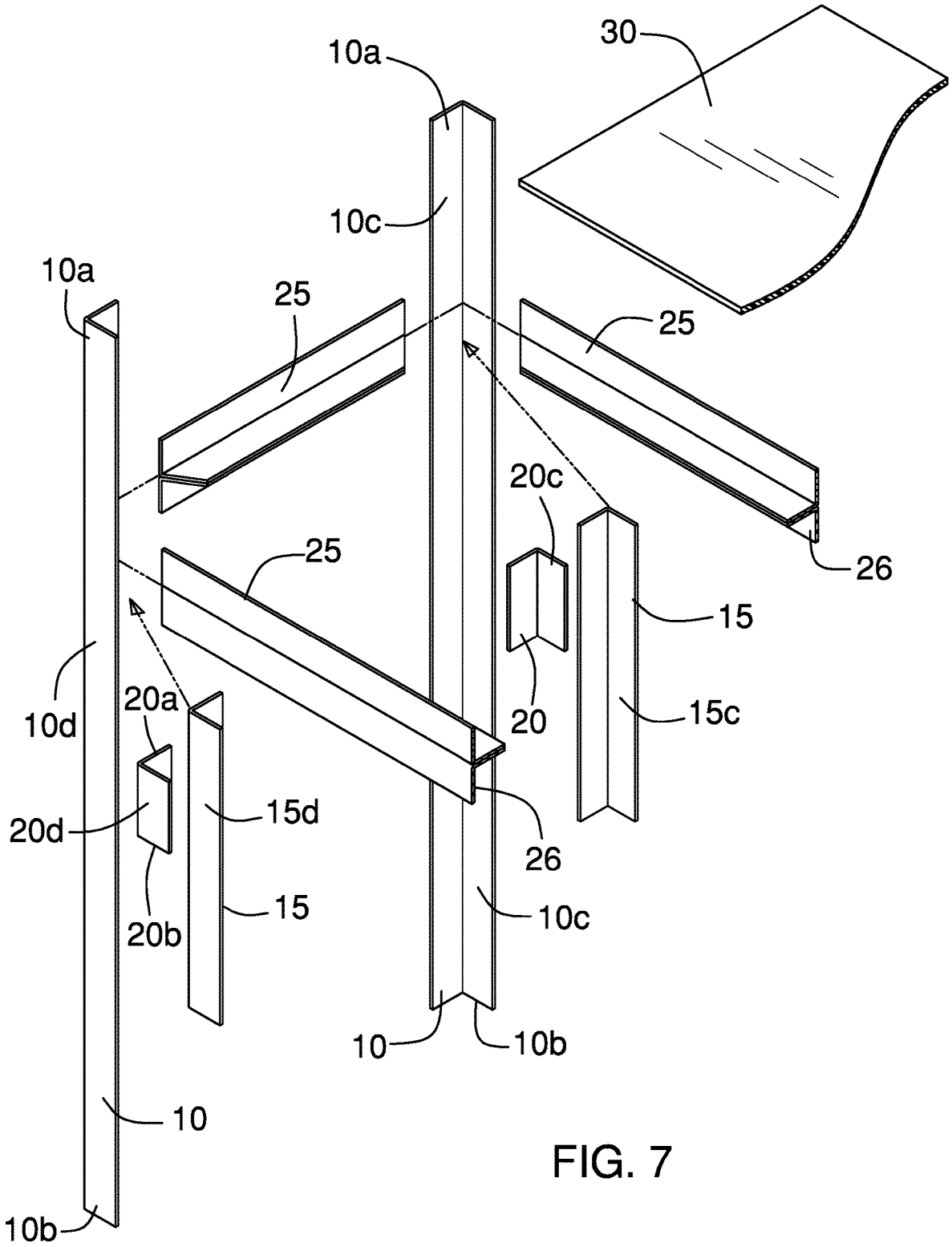
FIG. 7 is a partial exploded view of the first embodiment.

Each of the plurality of upper horizontal supports 25 are attached to each of the plurality of lower horizontal supports 26, which creates a top lip 25*a*, a bottom lip 26*a*, a top surface 25*b*, and a bottom surface 26*b*, as shown in FIG. 1 and in FIG. 6. The top lip 25*a* provides primarily two benefits, which include assisting with the securement of an inserted shelf panel 30 and preventing plants from falling off of a shelf panel 30. The plurality of upper horizontal supports 25 and the plurality of lower horizontal supports 26 are attached to the outer vertical supports 10 as shown in FIG. 6.

The plurality of inner vertical supports 15, each provide a top edge 15*a*, a bottom edge 15*b*, an inside surface 15*c*, and an exterior surface 15*d*. The plurality of inner vertical supports 15 are provided between the bottom surface 26*b* of the plurality of lower horizontal supports 26 and the base 6. In the instance that the rack provides more than one row of shelves, as shown in FIG. 1, the plurality of inner vertical supports 15 are also provided between the top surface 25*b* of the plurality of upper horizontal supports 25 for a lower shelf and the bottom surface 26*b* of the plurality of lower horizontal supports 26 for a upper shelf. For a second or higher row of shelves, the plurality of inner vertical supports 15 may alternatively be placed between a shelf panel 30 and the bottom surface 26*b* of the plurality of lower horizontal supports 26.

Consequently, the bottom lip 26*a* of the plurality of lower horizontal supports 26 and the top lip 25*a* of the plurality of upper horizontal supports 25 create a space between the plurality of inner vertical supports 15 and the plurality of outer vertical supports 10. It is critical that the plurality of inner vertical supports 15 and the plurality of outer vertical supports 10 maintain a substantially perpendicular orientation relative to the base 6 and one or more shelve panels.

The plurality of support spacers 20 are provided within the space between the plurality of outer vertical supports 10 and the plurality of inner vertical supports 15, which is shown in FIG. 6. Each support spacer within the plurality of support spacers 20 is further comprised of a top end 20*a*, a bottom end 20*b*, and interior surface 20*c*, and an exterior surface 20*d*. Although FIG. 6 shows a support spacer with gaps between the bottom lip 26*a* of a lower horizontal support and the top lip 25*a* of an upper horizontal support, it is anticipated that the plurality of support spacers 20 may extend from the top lip 25*a* to the bottom lip 26*a*.

A plurality of staples 40 are used to attach the plurality of upper horizontal supports 25, the plurality of lower horizontal supports 26, the plurality of outer vertical supports 10, the plurality of inner vertical supports 15, and the plurality of support spacers 20 together. The staples 40 may also be used to attach each shelf panel 30 or base 6 to the shipping frame as well.

Second Embodiment

This second embodiment 50 is distinguished from the first embodiment 5 in that the shipping rack is comprised of a base 6, a plurality of water resistant paper based composite supports, at least one shelf panel 30 and a plurality of rack straps 60. The plurality of supports are comprised of a plurality of outer vertical supports 10, a plurality of inner vertical supports 15, a plurality of support spacers 20, a plurality of lower horizontal supports 26 and a plurality of diagonal supports 55.

Figure 8:
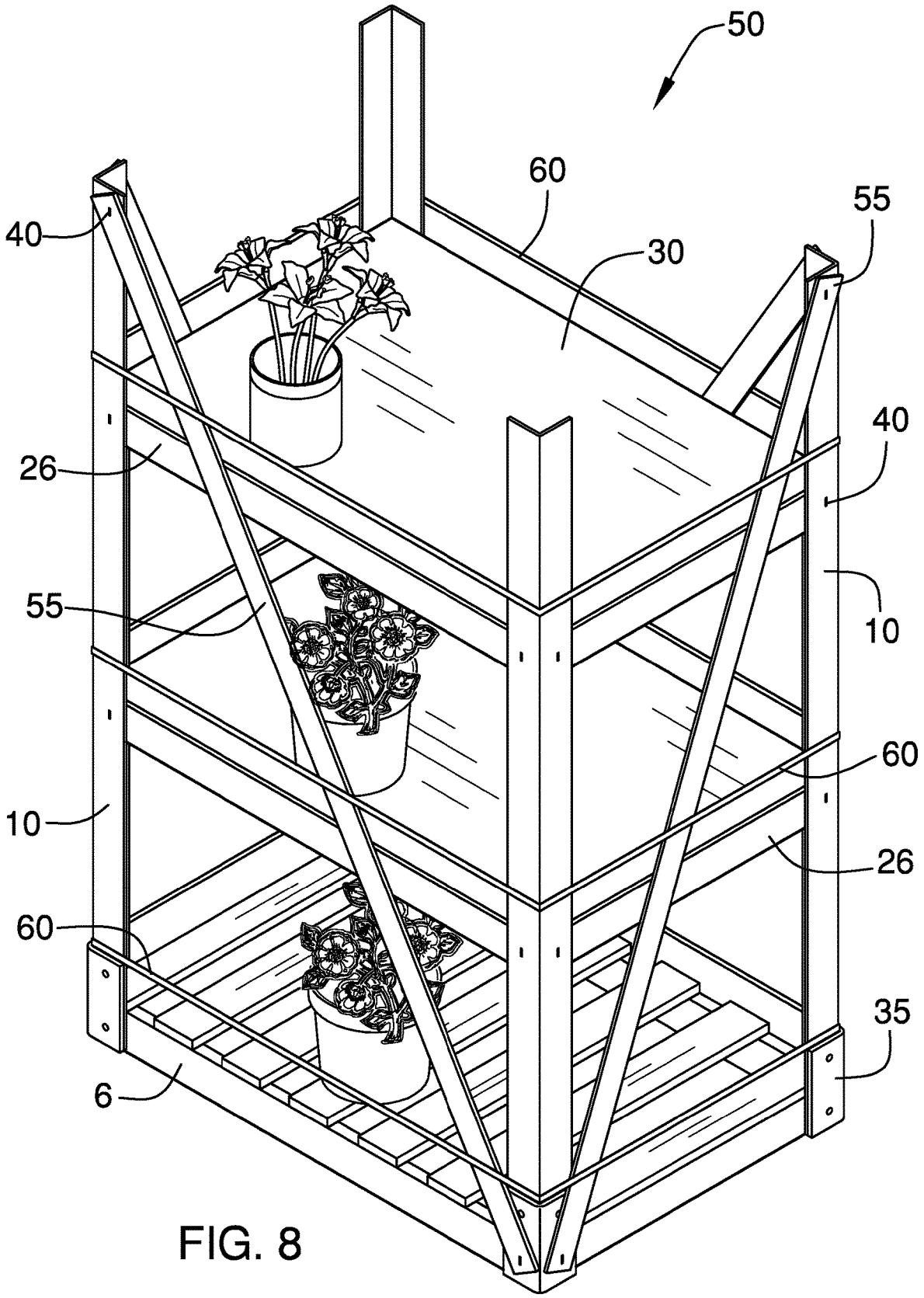
FIG. 8 is a front isometric view of the second embodiment.
Figure 9:
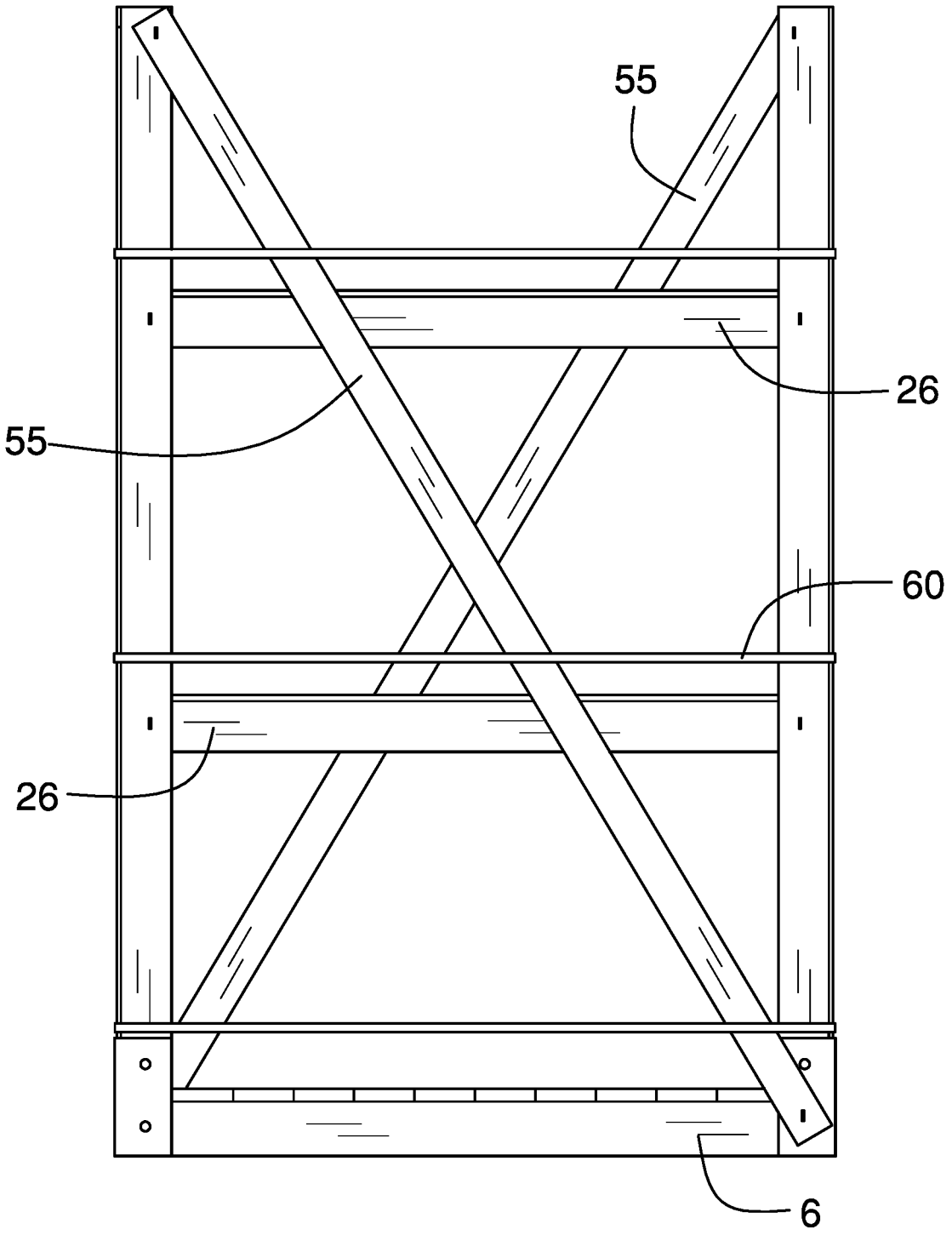
FIG. 9 is a front view of the second embodiment.

By only providing a plurality of lower horizontal supports 26 for a shelf panel 30 to rest on, it removes the top lip 25*a* and thus allows for sliding plants on and off of the shelf panel 30. The plurality of diagonal supports 55 are attached to the plurality of outer vertical supports 10, as shown in FIG. 8. The plurality of diagonal supports 55 increase the stability of the rack while supporting nursery plants during shipment. The plurality of rack straps 60 are provided around the plurality of outer vertical supports 10 and the plurality of diagonal supports 55. The plurality of rack straps 60 are low-weight and prevent one of the plurality of outer vertical supports 10 from separating from the rack.

The plurality of diagonal supports 55 and plurality of rack straps 60 also assist with preventing the nursery plants from falling out of the rack during shipment.

Third Embodiment

This third embodiment 100 is distinguished from the first and second embodiments in that a plurality of angle shelf boards 110. The plurality of angle shelf boards 110 is placed on the upper horizontal supports 25 to support nursery plants during shipment. It is critical that each angle shelf board have the angle pointed upward so water can shed off the plurality angle shelf boards 110. Although the recycled paper composite material of the plurality of angle shelf boards 110 is water resistant, the ability to shed water from the recycled material is critical for the stability of the shipping rack.

Figure 10:
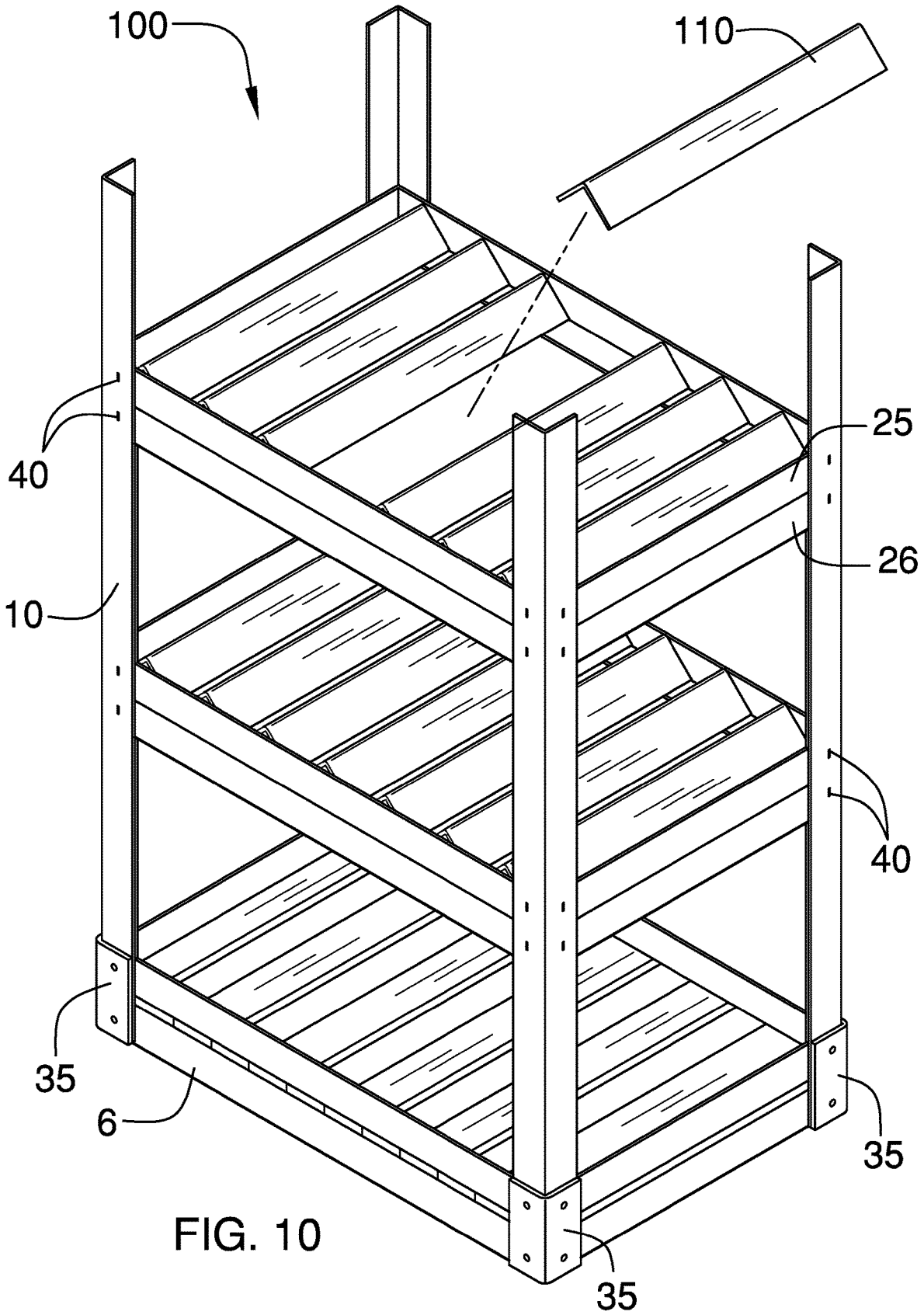
FIG. 10 is a front isometric view of the third embodiment.

The plurality of angle shelf boards 110 can span across the entire width of the plurality of upper horizontal supports 25, as shown in FIG. 10, and can be secured to the plurality of upper horizontal supports 25. Alternatively, the plurality of angle shelf boards 110 can span partially across the plurality of upper horizontal supports 25. Consequently, this would allow for a taller plant to be positioned on the base 6 and extend up through the plurality of lower horizontal supports 26 and plurality of upper horizontal supports 25 while still allowing shorter plants to sit on the existing plurality of angle shelf boards 110. In other words, the plurality of angle shelf boards 110 can be arranged such that a shipping rack can secure both tall and short plants during shipment.

With the use of a recycled paper based composite material for the plurality of supports, it provides nurseries with a third option that is dependable, economical, and environmental. While the embodiments of the invention have been disclosed, certain modifications may be made by those skilled in the art to modify the invention without departing from the spirit of the invention.

The inventor claims:

1. A nursery shipping rack, which is comprised of:

a) a base;

wherein the base comprises a top, a bottom, and a plurality of corners;

wherein the base is configured to rest upon a floor;

b) a plurality of L-shaped outer vertical supports;

wherein each outer vertical support comprises a top end, a bottom end, an interior surface, and an exterior surface;

wherein the bottom end of each outer vertical support is attached to the base;

wherein the plurality of outer vertical supports are made from a recycled paper composite material that is water resistant;

c) a plurality of L-shaped inner vertical supports;

wherein the plurality of inner vertical supports each comprise a top end, a bottom end, an interior surface, and an exterior surface;

wherein the plurality of inner vertical supports are made from a recycled paper composite material that is water resistant;

d) a plurality of upper horizontal supports; wherein each of the plurality of upper horizontal supports comprises a horizontal top surface and a vertical top lip extending upward and perpendicular from the horizontal top surface;

wherein the top lip of each of the plurality of upper horizontal supports are provided between the plurality of outer vertical supports and the plurality of inner vertical supports;

wherein the plurality of upper horizontal supports are made from a recycled paper composite material that is water resistant;

e) a plurality of lower horizontal supports; wherein each of the plurality of lower horizontal supports comprises a horizontal bottom surface and a vertical bottom lip extending downward and perpendicular from the horizontal bottom surface;

wherein the upper horizontal supports abut the lower horizontal supports respectively;

wherein the bottom lip of each of the plurality of lower horizontal supports are provided between the plurality of outer vertical supports and the plurality of inner vertical supports;

wherein the plurality of lower horizontal supports are made from a recycled paper composite material that is water resistant;

f) a plurality of support spacers;

wherein each support spacers comprises a top end, a bottom end, an interior surface, and an exterior surface;

wherein the exterior surface of each support spacer is adjacent to the interior surface of each of the plurality of the outer vertical supports respectively;

wherein the interior surface of each support spacer is adjacent to the exterior surface of each of the plurality of inner vertical supports respectively;

wherein the plurality of support spacers are made from a recycled paper composite material that is water resistant;

g) at least one shelf panel; wherein each shelf panel is placed on the plurality horizontal supports respectively.

2. The nursery shipping rack as described in claim 1, further comprising a plurality of diagonal supports.

3. The nursery shipping rack as described in claim 1, wherein a plurality of rack straps are provided around the plurality of outer vertical supports.

4. A nursery shipping rack, which is comprised of:

a) a base;

wherein the base comprises a top and a plurality of corners;

wherein the base is configured to rest upon a floor;

b) a plurality of L-shaped outer vertical supports;

wherein each outer vertical support comprises a top end, a bottom end, an interior surface, and an exterior surface;

wherein the bottom end of each outer vertical support is attached to the base;

wherein the plurality of outer vertical supports are made from a recycled paper composite material that is water resistant;

c) a plurality of L-shaped inner vertical supports;

wherein the plurality of inner vertical supports each comprise a top end, a bottom end, an interior surface, and an exterior surface;

wherein the plurality of inner vertical supports are made from a recycled paper composite material that is water resistant;

d) a plurality of L-shaped lower horizontal supports;

wherein each of the plurality of lower horizontal supports comprises a vertical bottom lip, a horizontal bottom surface, and a horizontal top surface;

wherein the bottom lip extends downward and perpendicular from the top and bottom surfaces of each lower horizontal support respectively;

wherein the bottom lip of each of the plurality of lower horizontal supports is provided between the plurality of outer vertical supports and the plurality of inner vertical supports;

wherein the plurality of lower horizontal supports are made from a recycled paper composite material that is water resistant;

e) a plurality of support spacers;

wherein the plurality of support spacers are made from a recycled paper composite material that is water resistant;

wherein each support spacers comprises a top end, a bottom end, an interior surface, and an exterior surface;

wherein the exterior surface of each support spacer is adjacent to the interior surface of each of the plurality of the outer vertical supports respectively;

wherein the interior surface of each support spacer is adjacent to the exterior surface of each of the plurality of inner vertical supports respectively;

f) a plurality of diagonal supports;

wherein the plurality of diagonal supports are made from a recycled paper composite material that is water resistant;

wherein the plurality of diagonal supports are attached to the plurality of outer vertical supports;

g) a plurality of rack straps;

wherein the plurality of rack straps are provided around the plurality of outer vertical supports and the plurality of diagonal supports;

h) at least one shelf panel;

wherein each shelf panel is placed on the plurality of lower horizontal supports respectively.

5. The nursery shipping rack as described in claim 4, wherein the base is made from a recycled paper composite material that is water resistant.

6. The nursery shipping rack as described in claim 4, wherein each shelf panel is made from a recycled paper composite material that is water resistant.

7. A nursery shipping rack shipping rack, which is comprised of:

a) a base;

wherein the base comprises a top and a plurality of corners;

wherein the base is configured to rest upon a floor;

b) a plurality of L-shaped outer vertical supports;

wherein each outer vertical support comprises a top end, a bottom end, an interior surface, and an exterior surface;

wherein the bottom end of each outer vertical support is attached to the base;

wherein the plurality of outer vertical supports are made from a recycled paper composite material that is water resistant;

c) a plurality of L-shaped inner vertical supports;

wherein the plurality of inner vertical supports comprise a top end, a bottom end, an interior surface, and an exterior surface;

wherein the plurality of inner vertical supports are made from a recycled paper composite material that is water resistant;

d) a plurality of upper horizontal supports;

wherein each of the plurality of upper horizontal supports comprises a horizontal top surface and a vertical top lip extending upward and perpendicular from the horizontal top surface;

wherein the top lip of each of the plurality of upper horizontal supports is provided between the plurality of outer vertical supports and the plurality of inner vertical supports respectively;

wherein the plurality of upper horizontal supports are made from a recycled paper composite material that is water resistant;

e) a plurality of lower horizontal supports; wherein each of the plurality of lower horizontal supports comprises a horizontal bottom surface and a vertical bottom lip extending downward and perpendicular from the horizontal bottom surface;

wherein the upper horizontal supports abut the lower horizontal supports respectively;

wherein the bottom lip of each of the plurality of lower horizontal supports are provided between the plurality of outer vertical supports and the plurality of inner vertical supports;

f) a plurality of support spacers;

wherein the plurality of support spacers are made from a recycled paper composite material that is water resistant;

wherein each support spacers comprises a top end, a bottom end, an interior surface, and an exterior surface;

wherein the exterior surface of each support spacer is adjacent to the interior surface of each of the plurality of the outer vertical supports respectively;

wherein the interior surface of each support spacer is adjacent to the exterior surface of each of the plurality of inner vertical supports respectively;

g) a plurality of angle shelf boards;

wherein the plurality of angle shelf boards are attached to the top surfaces of the plurality of upper horizontal supports and extend upwardly therefrom.

8. The nursery shipping rack as described in claim 7, wherein a plurality of diagonal supports are attached to the plurality of outer vertical supports.

9. The nursery shipping rack as described in claim 7, wherein a plurality of rack straps are provided around the of outer vertical supports.

* * * * *